US009597576B2

(12) United States Patent
Peterson et al.

(10) Patent No.: US 9,597,576 B2
(45) Date of Patent: Mar. 21, 2017

(54) METHOD AND DEVICE FOR IMPROVING PUTTING

(76) Inventors: Jack W. Peterson, Elkridge, UT (US); Scott B. Ferguson, Spanish Fork, UT (US)

( * ) Notice: Subject to any disclaimer, the term of this patent is extended or adjusted under 35 U.S.C. 154(b) by 960 days.

(21) Appl. No.: 12/240,086

(22) Filed: Sep. 29, 2008

(65) Prior Publication Data

US 2010/0081520 A1 Apr. 1, 2010

(51) Int. Cl.

| | |
|---|---|
| ***A63B 69/36*** | (2006.01) |
| ***A63B 71/06*** | (2006.01) |
| ***A63B 24/00*** | (2006.01) |

(52) U.S. Cl.

CPC ..... *A63B 69/3676* (2013.01); *A63B 24/0021* (2013.01); *A63B 69/3658* (2013.01); *A63B 71/0622* (2013.01); *A63B 2024/0028* (2013.01); *A63B 2024/0031* (2013.01); *A63B 2024/0037* (2013.01); *A63B 2071/0625* (2013.01); *A63B 2071/0691* (2013.01); *A63B 2220/12* (2013.01);

(Continued)

(58) Field of Classification Search

CPC ..... A63B 2220/30; A63B 69/3676; A63B 69/3658; A63B 24/0021; A63B 71/0622; A63B 2024/0028; A63B 2024/0031; A63B 2024/0037; A63B 2071/0625; A63B 2071/0691; A63B 2220/12; A63B 2220/53; A63B 2225/20; A63B 2225/50

USPC ..... 463/7

See application file for complete search history.

(56) References Cited

U.S. PATENT DOCUMENTS 5,582,554 A 12/1996 Stryczek
6,059,672 A * 5/2000 Zeiner-Gundersen ..... 473/407

(Continued)

FOREIGN PATENT DOCUMENTS

EP 1810723 A1 * 7/2007
KR 1020090077176 4/2010

OTHER PUBLICATIONS

Domenech, A. et al., Introduction to the study of rolling friction, pp. 231-235, Mar. 1987, American Journal of Physics 55(3), 231-235.

(Continued)

*Primary Examiner* — Werner Garner

(74) *Attorney, Agent, or Firm* — Jarod R. Marrott; Kirton McConkie, PC

(57) ABSTRACT

Implementations of the present invention provide systems and methods for providing a golfer putting information. Preferred embodiments may provide a golfer with optimal ball trajectory, including the initial path the ball should be stuck on, point to which the ball should be struck and optimal force with which the ball should be struck. In preferred embodiments a golfer utilizes a mobile putting device, which may be placed anywhere on or around a putting surface, where a putting surface may be any suitable environment for striking a golf ball with a putter. Preferred embodiments of the putting device are structured to allow alignment with the cup and/or stationary object, indicate where the ball should be placed, indicate the optimal line on which the ball should be struck and the computed force with which the ball should be struck. Some embodiments are structured to provide a golfer with feedback on the distance a practice swing would move the ball if struck, or after an actual putt, how hard the ball was hit with respect to the calculated target.

26 Claims, 11 Drawing Sheets

(52) U.S. Cl.
CPC ..... *A63B 2220/30* (2013.01); *A63B 2220/53* (2013.01); *A63B 2225/20* (2013.01); *A63B 2225/50* (2013.01)

(56) References Cited

U.S. PATENT DOCUMENTS

| | | | | |
|---|---|---|---|---|
| 6,093,923 | A | 7/2000 | Vock et al. | |
| 6,638,173 | B2 | 10/2003 | Robinson | |
| 6,890,273 | B1 | 5/2005 | Perez | |
| 7,134,966 | B1 * | 11/2006 | Tice | 473/220 |
| 8,285,768 | B2 | 10/2012 | Fenney | |
| 8,444,149 | B2 | 5/2013 | Sweeney | |
| 8,467,579 | B2 | 6/2013 | Cho et al. | |
| 2002/0016210 | A1 | 2/2002 | Helber | |
| 2002/0052750 | A1 * | 5/2002 | Hirooka | 705/1 |
| 2005/0101415 | A1 * | 5/2005 | Sweeney | 473/407 |
| 2005/0192124 | A1 | 9/2005 | Tetens et al. | |
| 2005/0227791 | A1 | 10/2005 | McCreary et al. | |
| 2007/0010341 | A1 * | 1/2007 | Miettinen et al. | 473/131 |
| 2007/0129178 | A1 | 6/2007 | Reeves | |
| 2008/0102972 | A1 * | 5/2008 | Lindsay | 473/251 |
| 2008/0182685 | A1 * | 7/2008 | Marty et al. | 473/407 |
| 2010/0081520 | A1 | 4/2010 | Peterson et al. | |
| 2012/0004956 | A1 | 1/2012 | Huston et al. | |

OTHER PUBLICATIONS

Elert, G., The Physics Hypertextbook: Rotational Inertia, http://physicsinfo/rotational-inertia/, Retrieved Sep. 11, 2014.

* cited by examiner

METHOD AND DEVICE FOR IMPROVING PUTTING

BACKGROUND OF THE INVENTION

1. Field of the Invention

The present invention relates generally to golfing, and more particularly to a method and device for improving putting.

2. Background and Related Art

Because approximately half of the strokes taken by a typical golfer are on the putting surface, golf can be won or lost on the greens. Consequently, being able to accurately read a green to determine the path the ball will roll on and force to use for a particular putt is an important part of a golfer's game. A golfer's ability to read greens accurately is a skill that must be developed through practice. Developing the ability to accurately assess the path that a ball will track and the speed at which the golf ball should be struck to make a putt on any green requires good feedback and many repetitions. Receiving immediate, accurate and reliable feedback as a golfer practices is the key to efficient learning. If a golfer fails to receive feedback on a read of the green the golfer will not be able to learn from the green reading mistakes and may continue to repeat the same mistakes over and over again. For example a golfer may inappropriately attribute a missed putt to an improper strike of the golf ball, when in fact the missed putt was a product of failing to appropriately read the contours of the green, the speed of the putt and the concomitant path that a golf ball will roll.

Developing the skill to accurately read a green to determine the path a golf ball will take when struck with a given force is difficult to do. A golfer must accurately assess the speed of the green and how the contours of the green will affect the path of the ball. The process for determining the speed of the green includes a read of the type of grass utilized to make the putting surface, the grain of the putting surface, current wind conditions, the time of day, the length of grass, the contours of the green itself, the lie of the land surrounding the greens (e.g., whether the green is next to water or constructed on a hillside), etc. Because the assessment process is complicated, a golfer's most important tool in reading a green is the golfer's subconscious mind. Providing a golfer with the opportunity to read a green and immediately provide feedback on the accuracy of the read allows a golfer to receive the type of immediate, accurate and reliable feedback necessary to efficiently learn the ability to read greens.

In addition to an accurate read of the green, the ability to strike a solid putt requires that a golfer strike the ball with the appropriate amount of force in a line with the correct read with a square putter face. Determining how hard to strike a golf ball, like green reading, is a process largely informed by the subconscious mind. The process of determining what type of stroke to put on a ball is often done by feel, in which the golfer repetitively swings the club back and forth in a motion simulating the putt before approaching and striking the ball. A golfer should receive accurate, immediate, and reliable feedback on a practice stroke to efficiently learn how hard a ball should be struck given an accurate read of the green. Further it would be useful to be able to practice developing this type of feel both on and off the course. Spending time each day at home practicing, while receiving immediate, accurate and reliable feedback will dramatically improve a golfer's ability to strike a ball with the appropriate amount of force.

BRIEF SUMMARY OF THE INVENTION

Implementations of the present invention provide systems and methods for providing a golfer putting information. Preferred embodiments may provide a golfer with optimal ball trajectory, including the initial path the ball should be stuck on, point to which the ball should be struck and optimal force with which the ball should be struck. In preferred embodiments a golfer utilizes a mobile putting device, which may be placed anywhere on, or around, a putting surface, where a putting surface may be any suitable environment for striking a golf ball with a putter. Preferred embodiments of the putting device are structured to allow alignment with the cup or fixed object, indicate where the ball should be placed, indicate the line on which the ball should be struck and the force with which the ball should be struck. Some embodiments are structured to provide a golfer with feedback on the distance a practice swing would move the ball if struck.

Preferred embodiments of the training method comprise an initial set up phase. In one embodiment a mobile putting device is placed on the putting surface. The golfer initiates the alignment of the mobile putting device by actuating the device either remotely with a control or manually by pressing a button on the device itself. In some embodiments, once the alignment phase has been initiated the device projects a line along the green. Either remotely detecting a transceiver in the flag or cup or allowing the golfer to manually align the device to ensure that the device is aligned exactly with the cup.

In some embodiments, once alignment of the device has been accomplished topography data may be accessed and calculations may be performed to determine the position of the device.

Once positioned correctly the golfer may initiate a ball spot phase either remotely or manually by depressing a button on the device itself. The device may utilize location indicia to identify the position at which the ball should be placed. In some embodiments the distance between the ball spot and the device will be fixed and utilized as a means for calculating position of the ball relative to the position of the flag within the environment of a previously scanned topography. Alternatively the device may utilize location indicia, which may be subsequently adjusted by the putting device automatically, or golfer manually, to point to the ball spot, the position on the putting surface which the ball resides or will reside when struck by the golfer.

Once ball position and flag location have been identified relative to the position of the putting device, the player may take one or more practice swings, estimating the optimal force with which the ball should be struck. Subsequent to practice swings the putting device may indicate the optimal trajectory of the putt. The golfer may request this information remotely or by depressing a button on the device. Once activated the optimal trajectory phase provides the golfer with an aim point. The putting device may be structured to provide an aim point. For example the aim point may be displayed a laser dot projected onto the practice green.

Subsequent to receiving optimal trajectory information the player may take additional practice putting swings. In some embodiments the practice swings may be measured to provide the player with accurate, instant and reliable information including the actual force at impact and/or the path on with the ball was or would have been struck. Graphical representations may also be utilized to indicate how close the swing, or practice swing, was to optimal.

In preferred embodiments topographical data and the current green speed readings may be downloaded to the device before use. In some embodiments, the calculation of the intended putt parameters would be performed on the device. Alternatively topographical data and current stimpmeter readings may be store remotely and accessed via various networking systems during a training session.

In some embodiments the device may comprise a high resolution, digital compass that will provide the angle to true north, which may be utilized as a data point to triangulate the position of the device on the putting surface According to some embodiments, position identifiers may be placed proximate a putting green. The exact placement of the position identifiers may be included in the topographical scanning/mapping of the green. Each position identifier may be structured to broadcast a different signal. The signal may be a passive or active signal. These different signals received by the putting device placed on the green. The multiple signals from multiple position identifiers may provide the basis for triangulation/location of the newly drilled holes and to identify the placement of the putting device on the green by the golfer. The actual calculation could be performed by the device placed on the green, by the position identifiers or at a location remote from the green.

In some embodiments where calculations are performed by the position identifiers or at a remote location, the results from calculations performed may be transferred through a transmitter to the requesting device.

In some embodiments the power requirements for the position identifiers will be supplied by solar powered batteries.

In other embodiments a Global Positioning System (GPS) may be utilized to provide the location of the cup, ball, and putting device on the putting surface. In some embodiments the GPS information may be substituted with, or augmented by, Dual Frequency Global Positioning information, and Carrier Phase Global Positioning to augment the Global Positioning Information and/or Differential GPS information (DGPS).

In some embodiments utilizing a DGPS, one or more position identifiers at stationary, known locations, near to where accurate position determination is desired may be utilized. The position identifiers broadcast the range errors received from at least some and preferably all of the GPS satellites with which the position identifier is in communication with. In some embodiments the transmission of position information is by way of radio beacons. In other embodiments geostationary satellites and the Internet may be utilized.

In some embodiments DGPS receivers may use these correction messages, correlated with the satellite signals being received, to provide higher resolution positioning information.

In some embodiments a golfer may use audio cues to interact with the device. In some embodiments a golfer may speak commands into a headset or earpiece which transmits the commands to a relay device which are subsequently delivered to the putting device. Alternatively, the commands may be transferred directly to the putting device. Some embodiments may utilize Bluetooth technology to accomplish transmission of commands.

The putting device may be configured to adapt to different learning styles. The device may be capable of receiving learning style information or assessing learning style information as the machine is repeatedly utilized by a particular user. In some embodiments device may record data utilized to assess rate of improvement and correlate rate of improvement with variable feedback mechanisms.

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

BRIEF DESCRIPTION OF THE SEVERAL VIEWS OF THE DRAWINGS

The features of the present invention will become more fully apparent from the following description and appended claims, taken in conjunction with the accompanying drawings. Understanding that these drawings depict only typical embodiments of the invention and are, therefore, not to be considered limiting of its scope, the invention will be described and explained with additional specificity and detail through the use of the accompanying drawings in which:

DETAILED DESCRIPTION OF THE INVENTION

A description of embodiments of the present invention will now be given with reference to the Figures. It is expected that the present invention may take many other forms and shapes, hence the following disclosure is intended to be illustrative and not limiting, and the scope of the invention should be determined by reference to the appended claims.

Various embodiments of the present invention may be utilized to provide a golfer with information. In some embodiments the information may comprise the optimal line on which a putt should be struck. In some embodiments the information may comprise the optimal force with which the putt should be struck. In various embodiments a putting device 50 may be utilized as a standalone device, effectively carrying out all of the operations contemplated by the present invention or may be utilized in an operating network suitable for various applications.

Figure 1:
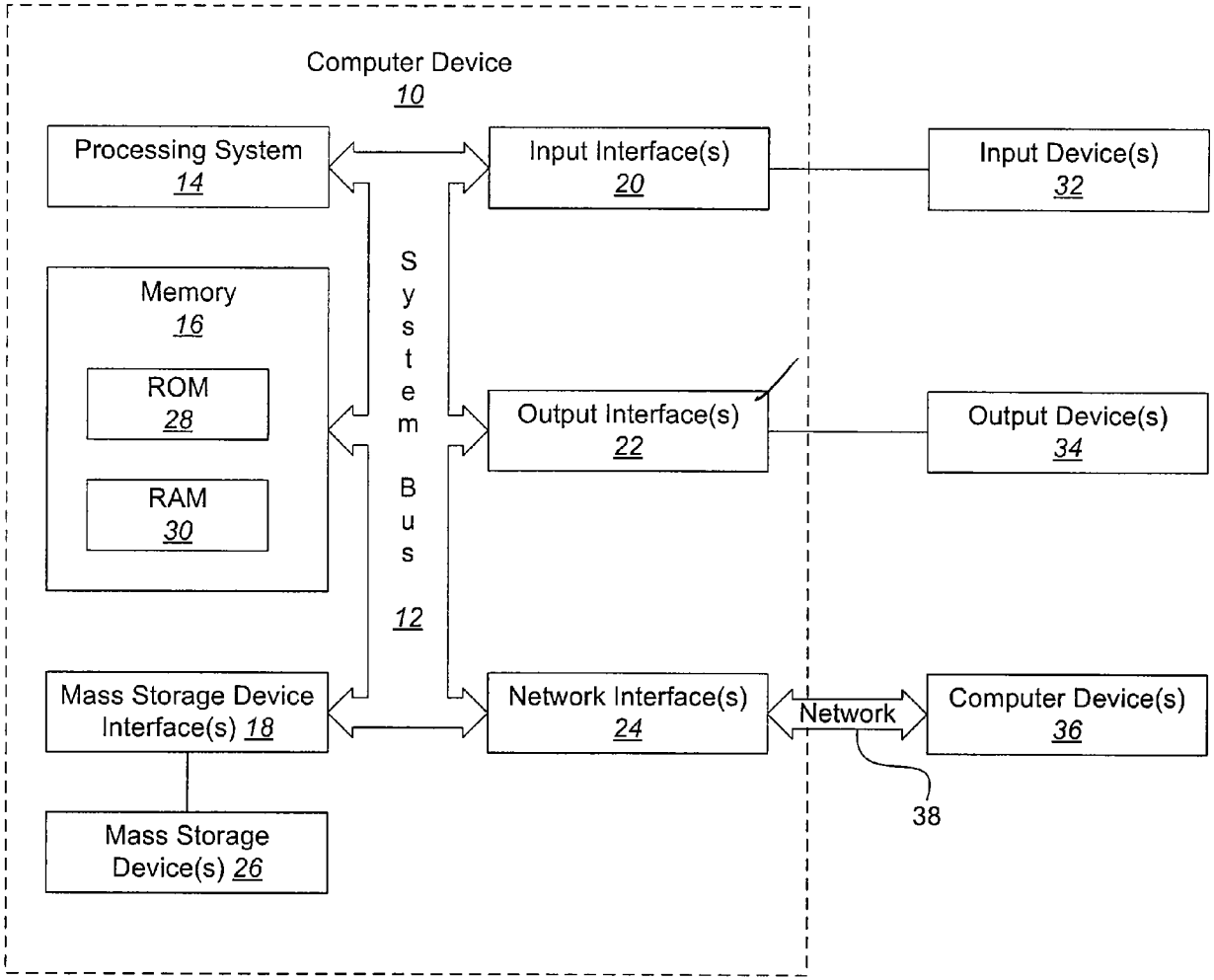
FIG. 1 shows a flow chart of a representative system that provides a suitable operating environment in which embodiments of the invention may be implemented.
Figure 2:
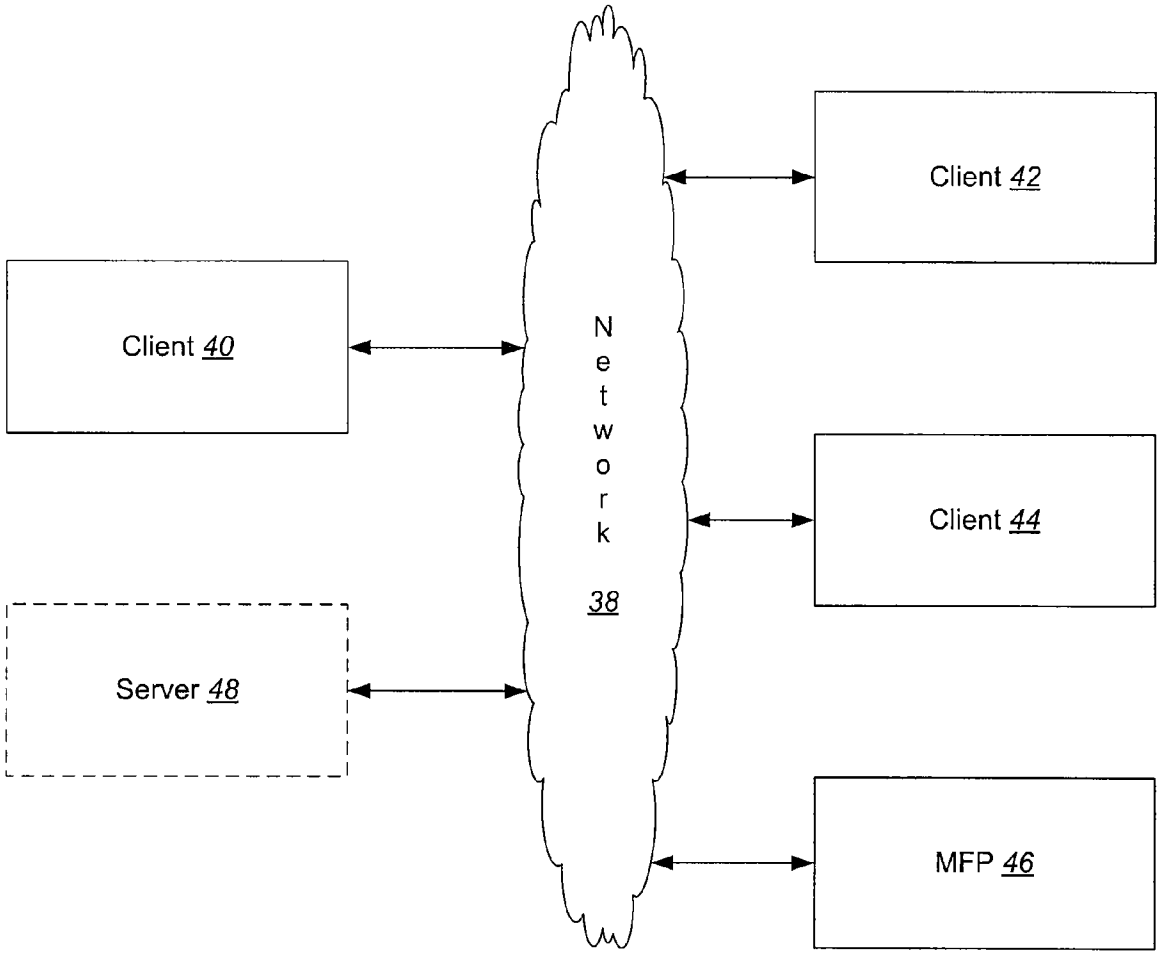
FIG. 2 shows a flow chart of a representative networking system that provides a suitable environment in which embodiments of the invention by be implemented.

Referring now to FIG. 1 and FIG. 2 and the corresponding discussion, which is intended to provide a general description of a suitable operating environment in which embodiments of the invention may be implemented. One skilled in the art will appreciate that embodiments of the invention may be practiced by one or more computing devices and in a variety of system configurations, including in a networked configuration. However, while the methods and processes of the present invention have proven to be particularly useful in association with a system comprising a general purpose computer, embodiments of the present invention include utilization of the methods and processes in a variety of environments, including embedded systems with general purpose processing units, digital/media signal processors (DSP/MSP), application specific integrated circuits (ASIC), stand alone electronic devices, and other such electronic environments.

Embodiments of the present invention embrace one or more computer readable media, wherein each medium may be configured to include or includes thereon data or computer executable instructions for manipulating data. The computer executable instructions include data structures, objects, programs, routines, or other program modules that may be accessed by a processing system, such as one associated with a general-purpose computer capable of performing various different functions or one associated with a special-purpose computer capable of performing a limited number of functions. Computer executable instructions cause the processing system to perform a particular function or group of functions and are examples of program code means for implementing steps for methods disclosed herein. Furthermore, a particular sequence of the executable instructions provides an example of corresponding acts that may be used to implement such steps. Examples of computer readable media include random-access memory ("RAM"), read-only memory ("ROM"), programmable read-only memory ("PROM"), erasable programmable read-only memory ("EPROM"), electrically erasable programmable read-only memory ("EEPROM"), compact disk read-only memory ("CD-ROM"), or any other device or component that is capable of providing data or executable instructions that may be accessed by a processing system.

With reference to FIG. 1, a representative system for implementing embodiments of the invention includes computer device 10, which may be a general-purpose or special-purpose computer. For example, computer device 10 may be a personal computer, a notebook computer, a personal digital assistant ("PDA") or other hand-held device, a workstation, a minicomputer, a mainframe, a supercomputer, a multiprocessor system, a network computer, a processor-based consumer electronic device, a mobile putting device 50, a position identifier 86, or the like.

Computer device 10 may include a system bus 12, which may be configured to connect various components thereof and enables data to be exchanged between two or more components. System bus 12 may include one of a variety of bus structures including a memory bus or memory controller, a peripheral bus, or a local bus that uses any of a variety of bus architectures. Typical components connected by system bus 12 include processing system 14 and memory 16. Other components may include one or more mass storage device interfaces 18, input interfaces 20, output interfaces 22, and/or network interfaces 24, each of which will be discussed below.

Processing system 14 includes one or more processors, such as a central processor and optionally one or more other processors designed to perform a particular function or task. It is typically processing system 14 that executes the instructions provided on computer readable media, such as on memory 16, a magnetic hard disk, a removable magnetic disk, a magnetic cassette, an optical disk, thumb drives, solid state memory, a universal serial bus or from a communication connection, which may also be viewed as a computer readable medium.

Memory 16 includes one or more computer readable media that may be configured to include or includes thereon data or instructions for manipulating data, and may be accessed by processing system 14 through system bus 12. Memory 16 may include, for example, ROM 28, used to permanently store information, and/or RAM 30, used to temporarily store information. ROM 28 may include a basic input/output system ("BIOS") having one or more routines that are used to establish communication, such as during start-up of computer device 10. RAM 30 may include one or more program modules, such as one or more operating systems, application programs, and/or program data.

One or more mass storage device interfaces 18 may be used to connect one or more mass storage devices 26 to system bus 12. The mass storage devices 26 may be incorporated into or may be peripheral to computer device 10 and allow computer device 10 to retain large amounts of data. Optionally, one or more of the mass storage devices 26 may be removable from computer device 10. Examples of mass storage devices include hard disk drives, magnetic disk drives, thumb drive tape drives and optical disk drives. A mass storage device 26 may read from and/or write to a magnetic hard disk, a removable magnetic disk, a magnetic cassette, an optical disk, or another computer readable medium. Mass storage devices 26 and their corresponding computer readable media provide nonvolatile storage of data and/or executable instructions that may include one or more program modules such as an operating system, one or more application programs, other program modules, or program data. Such executable instructions are examples of program code means for implementing steps for methods disclosed herein.

One or more input interfaces 20 may be employed to enable a user to enter data and/or instructions to computer device 10 through one or more corresponding input devices 32. Examples of such input devices include a keyboard and alternate input devices, such as a mouse, trackball, light pen, stylus, or other pointing device, a microphone, a joystick, a game pad, a satellite dish, a scanner, a camcorder, a digital camera, and the like. Similarly, examples of input interfaces 20 that may be used to connect the input devices 32 to the system bus 12 include a serial port, a parallel port, a game port, a universal serial bus ("USB"), an integrated circuit, a firewire (IEEE 1394), or another interface. For example, in some embodiments input interface 20 includes an application specific integrated circuit (ASIC) that is designed for a particular application. In a further embodiment, the ASIC is embedded and connects existing circuit building blocks.

One or more output interfaces 22 may be employed to connect one or more corresponding output devices 34 to system bus 12. Examples of output devices include a monitor or display screen, a speaker, a printer, a multi-functional peripheral, and the like. A particular output device 34 may be integrated with or peripheral to computer device 10. Examples of output interfaces include a video adapter, an audio adapter, a parallel port, and the like.

One or more network interfaces 24 enable computer device 10 to exchange information with one or more other local or remote computer devices, illustrated as computer devices 36, via a network 38 that may include hardwired and/or wireless links. Examples of network interfaces include a network adapter for connection to a local area network ("LAN") or a modem, wireless link, or other adapter for connection to a wide area network ("WAN"), such as the Internet. The network interface 24 may be incorporated with or peripheral to computer device 10. In a networked system, accessible program modules or portions thereof may be stored in a remote memory storage device. Furthermore, in a networked system computer device 10 may participate in a distributed computing environment, where functions or tasks are performed by a plurality of networked computer devices.

Thus, while those skilled in the art will appreciate that embodiments of the present invention may be practiced in a variety of different environments with many types of system configurations, FIG. 2 provides a representative networked system configuration that may be used in association with embodiments of the present invention. The representative system of FIG. 2 includes a computer device, illustrated as client 40, which is connected to one or more other computer devices (illustrated as client 42 and client 44) and one or more peripheral devices (illustrated as multifunctional peripheral (MFP) MFP 46) across network 38. While FIG. 2 illustrates an embodiment that includes a client 40, two additional clients, client 42 and client 44, one peripheral device, MFP 46, and optionally a server 48, connected to network 38, alternative embodiments include more or fewer clients, more than one peripheral device, no peripheral devices, no server 48, and/or more than one server 48 connected to network 38. Other embodiments of the present invention include local, networked, or peer-to-peer environments where one or more computer devices may be connected to one or more local or remote peripheral devices. Moreover, embodiments in accordance with the present invention also embrace a single electronic consumer device, wireless networked environments, and/or wide area networked environments, such as the Internet.

Implementations of the present invention provide systems and methods for providing a golfer putting information. Preferred embodiments may provide a golfer with optimal ball trajectory 94 including the initial path 92 the ball should be stuck on, point to which the ball should be struck 62 and optimal force 96 with which the ball 84 should be struck. In preferred embodiments a golfer utilizes a mobile putting device 50, which may be placed anywhere on or around a putting surface 52, where a putting surface 52 may be any suitable environment for striking golf balls with a putter. For example, a carpet floor or grass on a putting green are both non-limiting examples of suitable putting surfaces.

Optimal putt trajectory 94 reflects a combination of line 92 and speed. Various lines 92 may be selected depending upon the speed at which a putt is struck. The faster a golfer rolls the putt, the less it will break; and the slower a golfer rolls the putt, the more it will break. Consequently, a golfer may choose a very high line and roll the ball 84 so slowly that it breaks drastically down the slope. Alternatively, a golfer may play a low line closer to a straight aim line and strike the putt firmly into the cup 80. And there are countless combinations of aim lines and speeds in between. However, research indicates that there is always one optimum speed and one optimum aim line for holing the maximum percentage of putts from a given distance on the green 76.

Speed and line intertwine to produce optimum trajectory. Some research indicates that striking a putt that would roll approximately 17 inches past the back edge of a cup 80 is an optimal putting speed. The optimum distance past varies with almost every putt on every green 76 depending on surface conditions, whether the putt is uphill or downhill, what type of grass is utilized on the putting surface, etc. For example, because downhill putts have gravity assisting them to stay online, their optimum speed tends to be a little lower as they reach the hole, while uphill putts are being pulled offline by gravity every time they hit an imperfection. To keep uphill putts online, the optimum speed tends to be faster.

Another example of green 76 variation that affects optimum speed is the type of grass utilized. For example, Bermuda grass has a very strong grain, producing a situation in which optimum putting speed rolls a ball 84 as much as 36 inches past the back edge of the hole. This may be compared with situations in which greens 76 with very little grain have measured optimum speeds that roll a ball 84 only five inches past the cup. Algorithms may be utilized to process the topographical information previously scanned and information, including the type of grass utilized, to provide a golfer with precise information.

Figure 3:
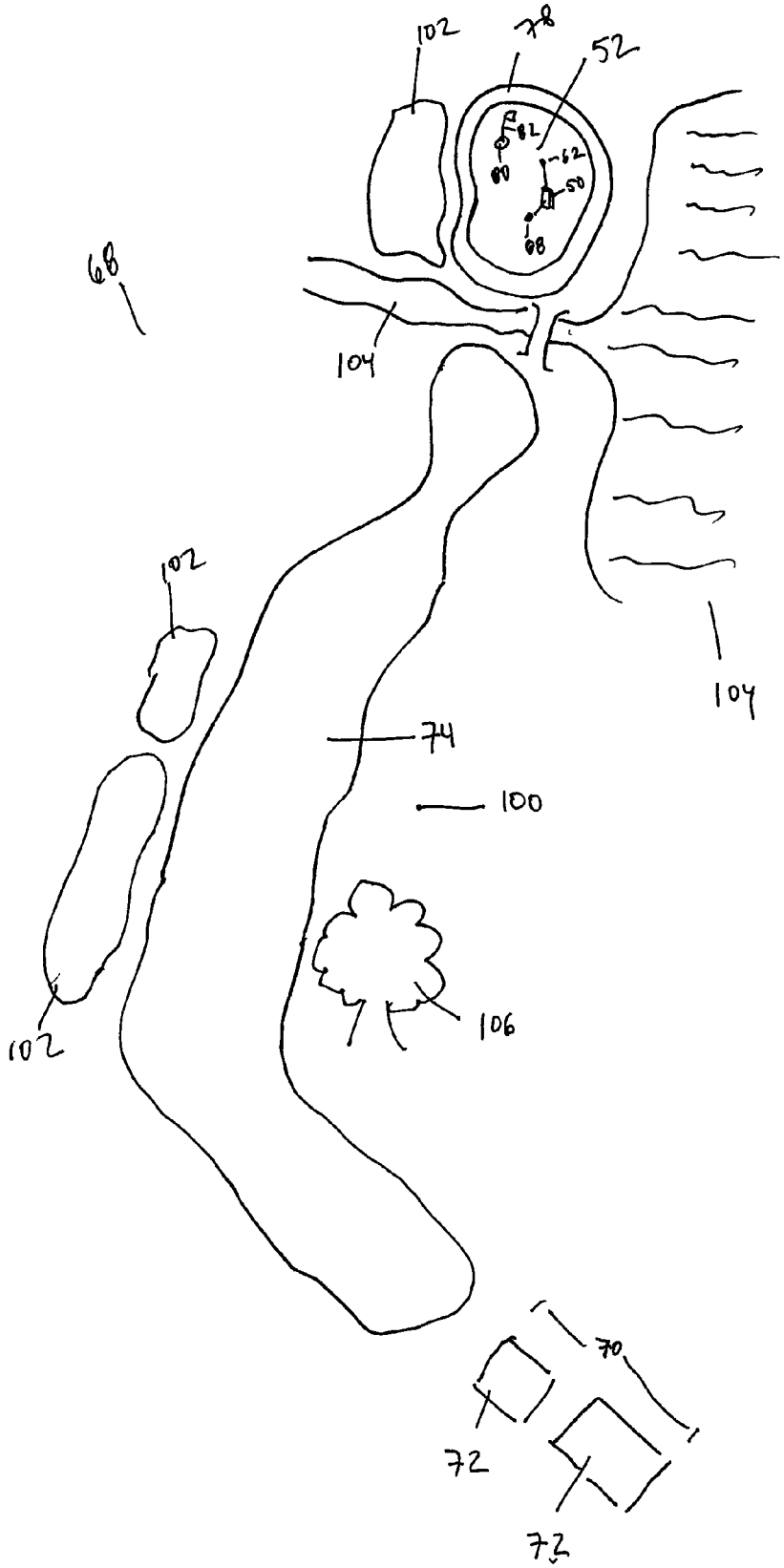
FIG. 3 shows a representation of an exemplary golf hole.

An example of a typical golf hole 68 is shown in FIG. 3. Golf hole 68 typically includes a tee area 70 having at least one tee box 72 and a green or putting surface 52 distal the tee area 70. Typically between the tee area 70 and the green or putting surface 52, is a fairway 74. Often, a fairway 74 is bounded on one or both sides by rough 100, sand traps 102, water 104, trees 106 or other obstacles.

Figure 4:
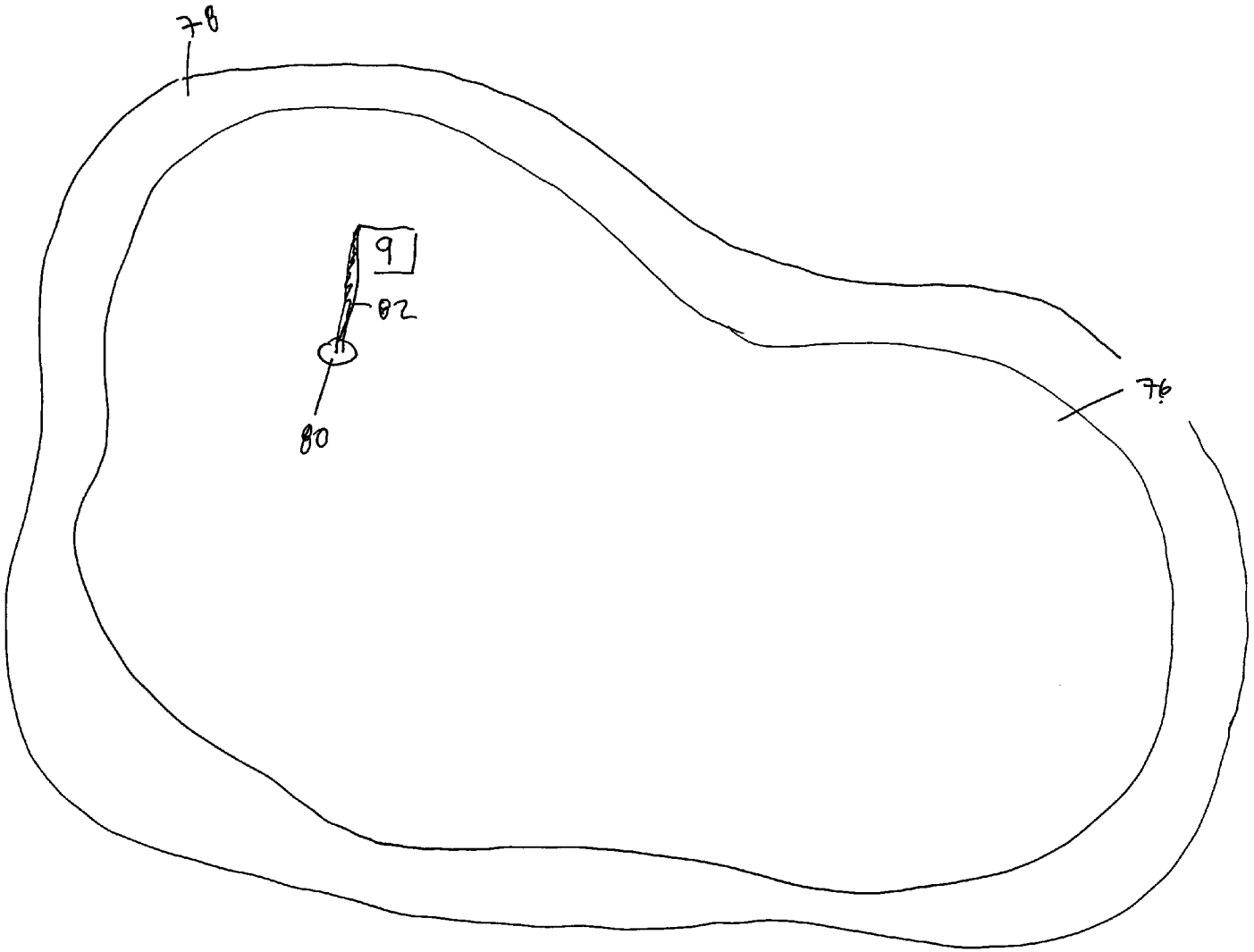
FIG. 4 shows a representation of an exemplary putting green.

A typical putting green 76 is shown in more detail in FIG. 4. Greens are often surrounded by a region of grass longer than the grass forming the green but shorter than the grass forming the fairway, referred to as an apron 78. A typical putting green 76 includes at least one cup 80 for putting with a ball 84 into. A cup 80 typically removably receives a pin or flag 82. Greens and surrounding surfaces are typically curved and exist at an angle to a horizontal plane. Because of the various slopes and curvatures in regions of a putting green 76 over which a golf ball 84 must travel, it is difficult to accurately predict the path along which a ball will travel when putted. Developing the capacity to accurately read the curvature, slopes and conditions of a green 76 in order to predict the path along which a ball 84 will travel, is a desirable skill.

Developing the skill to accurately read a green to determine the path a ball will take when struck with a given force is difficult to do. A golfer must accurately assess the speed of the green and how the contours of the green will affect the path of the ball. The process for determining the speed of the green includes a read of the type of grass utilized to make the putting surface, the time of day, the length of grass, the contours of the green itself, the lie of the land surrounding the greens, etc. For example, when a green 76 is next to water 104 or constructed on a hill side, the path the ball will take will be influenced by these surrounding features. Because the assessment process is complicated, practicing this assessment skill, while receiving feedback on the accuracy of the assessment to train the golfer, is desirable.

In preferred embodiments of the present invention, a putting device 50 is utilized in training method to assist a golfer in developing the skill of reading a green 76 and striking a putt with appropriate amounts of force. In preferred embodiments, the putting device 50 is of sufficiently small size to allow a golfer to transport the putting device 50 from one area of a putting surface 52 to another, from one putting surface 52 to another, from one golf course to another, or such that it may be utilized in a home environment to practice a putting stroke.

In preferred embodiments, the putting device 50 may be utilized to either store or interface with a storage device 26, which contains topographical information relative to a given green. Topographical information may include information pertinent to determining the speed at which a ball will roll and along what path the ball will roll when struck with a particular force. The green speed may be determined by any suitable method. For example, a Stimpmeter or other device may be utilized to measure the speed of the green. A Stimpmeter measures the distance a ball will travel over level ground given a defined strike force. A typical Stimpmeter has a metal ramp about 3 feet long. To use a Stimpmeter, a golf ball is placed at the top of the ramp and is raised from the surface of the green until gravity forces the ball out of a notch at the end of the ramp and onto a level section of the green. The distance the ball travels on the green is the speed value. Embodiments of the invention utilize the actual measured green speed for a day, or utilizing average speed values provided for greens on a particular course or in a particular geographic area. Some embodiments may utilize additional information to adjust speed values throughout the day.

Further embodiments of the invention may utilize algorithms to adjust green speed for the passage of time. For example, the length of grass on the green affects the speed at which the ball will roll. Over the course of the day, grass length increases and the Stimpmeter reading or other green speed measurement will change. Further, watering schedules and evaporation based on temperature during the day will affect the speed of the greens over the course of the given day. Accordingly, in some embodiments, the putting device 50 may utilize algorithms, which compensate for the various factors which affect the speed of greens during the day. Alternatively, the processing system 14 or computer device 10 located remotely from the putting device 50, may be utilized to process such algorithms and communicate the results via network 38 to the putting device 50 when utilized by a golfer practicing.

Some embodiments of the putting improvement device of the present invention contemplate utilizing topographical data acquired for each hole on a course or for a practice putting surface 52. The topographical data can be created using survey equipment and empirical testing. For example, survey equipment may be utilized to obtain corresponding to the shape and the topographical profile of any given green 76 or putting surface 52. Locations of recurring pin 82 positions or the locations of the actual pin 82 positions may also be acquired and included in the topographical data for each green 76 stored in memory 16.

Topographical data may be obtained using any suitable equipment. Any automated, semi-automated or manual technique may be utilized to acquire topographical data and input the data into a memory system to be utilized in calculating optimum trajectory 94 and optimal force 96. In preferred embodiments, the technique utilized will produce data stored in memory 16. In some embodiments, once topographical data has been stored in memory, another program may be utilized to receive the survey data and use the data to create a representation of the green. With an accurate representation of the green created, software may be utilized to calculate the path on which a ball 84 will roll when struck with a given force from any position on the green 76 to the cup 80. Accordingly, once topographical data has been stored and has been utilized by drafting programs to create a representation of a measured green 76, to calculate the force a ball should be struck with and along which line the ball 84 should be struck, requires input only of the position of the cup 80 on that specific day and the position from which the ball 84 is being struck.

As noted before, topographical information for each green surveyed and stored in memory may be supplemented with additional information about the greens. For example, the type of grass used on greens and the typical characteristics of the grass utilized. Other green characteristics that may be utilized to augment the accuracy of the information stored in memory may include the smoothness of the putting surface, the firmness of the putting surface, growth rates of grass on the putting surface, etc.

Further in some embodiments topographical information may be made available to individuals on the internet. Accordingly, a golfer may access green topography information before putting, or after putting, either to prepare for a practice putting session/round of golf or to evaluate the practice session or round of golf.

Figure 5:
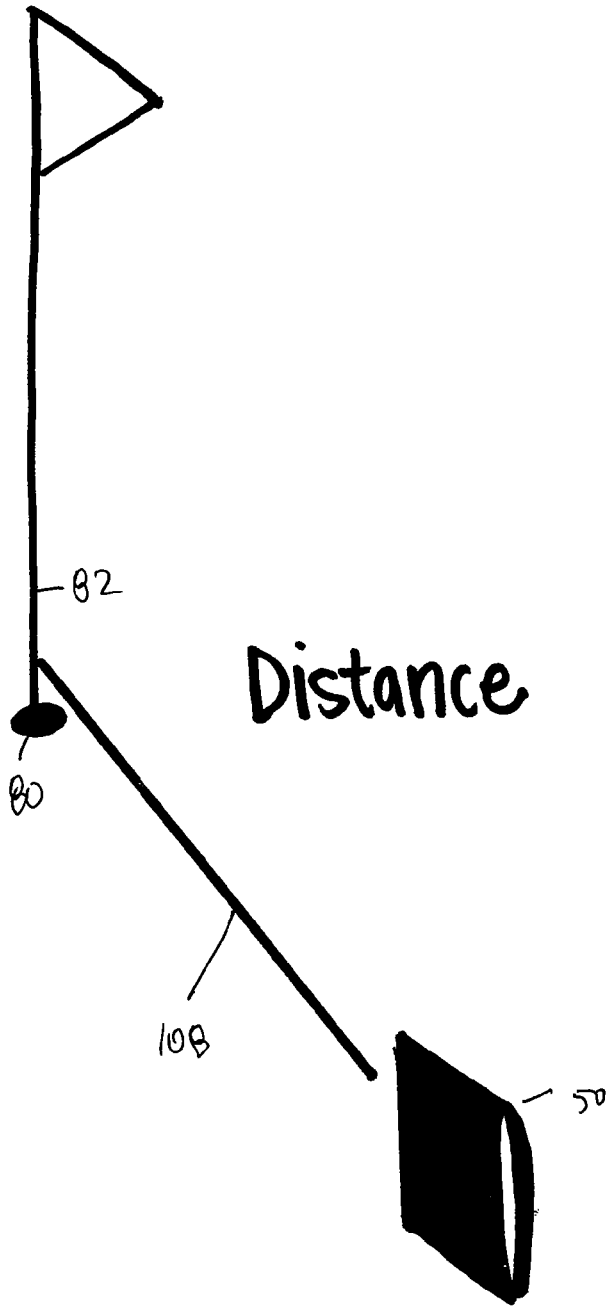
FIG. 5 shows a representation of a mobile putting device determining distance to a flagstick according to some embodiments of the invention.

To use any of the embodiments of the putting improvement device discussed herein, a golfer first identifies the position of the ball relative to the cup in an initial setup phase. Preferred embodiments of the training method comprise an initial set up phase. Referring to FIG. 5, which depicts a represent final set up phase according to some embodiments of the invention, a mobile putting device 50 is placed on the putting surface. The golfer initiates the alignment of the mobile putting device 50 by actuating the device either remotely with a control or manually by pressing a button on the device 50 itself. In some embodiments, once the alignment phase has been initiated the device projects a line 108 along the green. Either remotely detecting a transceiver in the flag 82 or cup 80 or allowing the golfer to manually align the device 50 to ensure that the device 50 is aligned exactly with the cup 80. The set up phase 56 allows data to be acquired which details the relative position of the putting device 50 to the cup 80.

In some embodiments a golfer may use audio cues to interact with the putting device 50. In some embodiments a golfer may speak commands into a headset or earpiece that either directly transmits the commands to a relay device or directly to the putting device 50. In some embodiments the relay device may be a personal device with processing capabilities (e.g., PDA) or a device resident at position proximate the putting surface 52, or a device at a position remote from the putting surface 52 but within network communication. The commands may be simple verbal cues utilized to turn on the putting device 50 or the mode of operation due use of the putting device 52. For example a golfer may provide the device with audio information including the hole number, the type of club being used, the practice facility being utilized, the course being played or to switch between phases in the putting process. Some embodiments may utilize Bluetooth technology to accomplish transmission of commands. In a non-limiting example a golfer may utilize their phone earpiece as the device used to communicate with the putting device 50. In a non limiting example, a golfer may place the device on the putting surface initiate the putting process then commence putting into various holes on the putting surface issuing commands intermittently as necessary to progress through the putting process.

Figure 6:
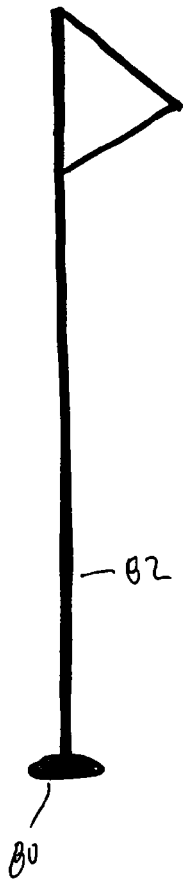
FIG. 6 shows a representation of a mobile putting device determining ball placement according to some embodiments of the invention.
Figure 6:
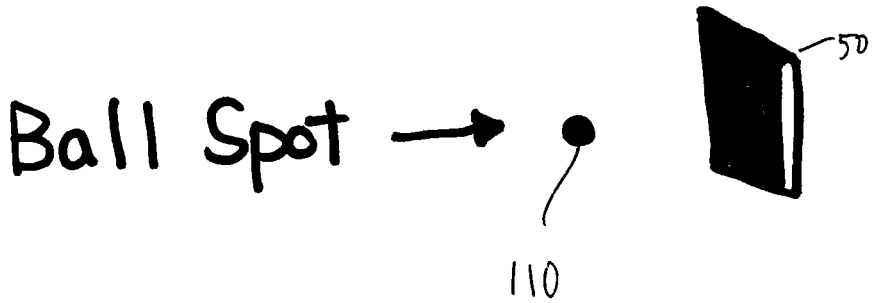

Once positioned correctly, the golfer may initiate a ball spot phase 58, either remotely or manually by depressing a button on the device itself. A representation of the ball spot phase according to some embodiments is depicted in FIG. 6. The device 50 then may utilize location indicia (e.g., a laser pointer) to identify the position at which the ball should be placed or to provide the system with information regarding the position of the ball relative to the putting device 50. In some embodiments, the distance between the ball spot 110 and the device 50 will be fixed and utilized as a means for calculating position of the ball 84 relative to the position of the flag 82 within the environment of a previously scanned topography. Alternatively, the device may utilize location indicia, which may be subsequently adjusted by the putting device 50 automatically, or golfer manually, to point to the ball spot 110, the position on the putting surface which the ball 84 resides or will reside when struck by the golfer.

Figure 7:
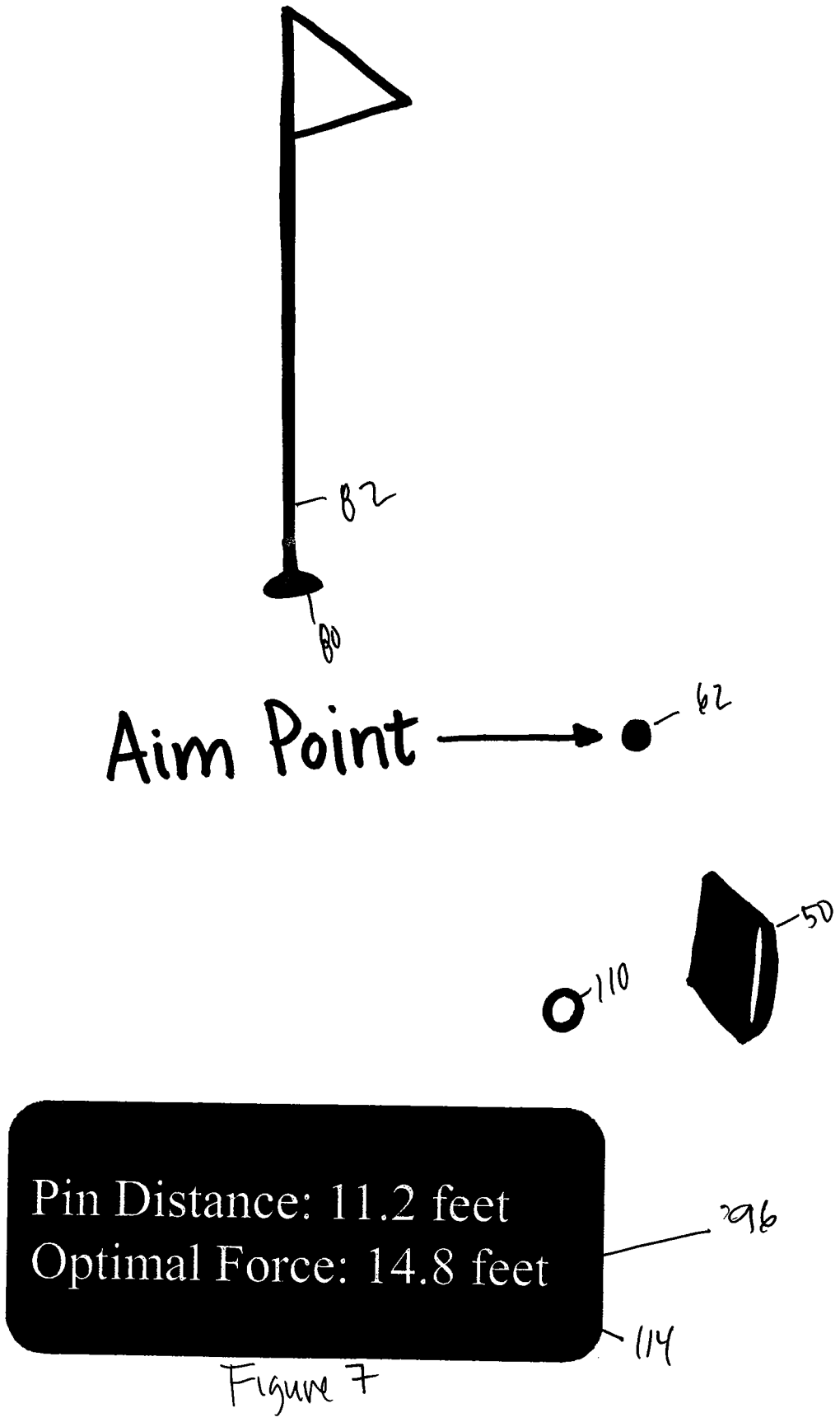
FIG. 7 shows a representation of a mobile putting device indicating aim point and ball placement according to some embodiments of the invention.

Referring to FIG. 7, once ball position 110 and flag 82 location have been identified relative to the position of the putting device 50, the player may take one or more practice swings, estimating the optimal force 96 with which the ball should be struck. The putting device may be utilized to acquire the optimal trajectory 94 of the putt. The golfer may request this information remotely or by depressing a button on the device 50. Once activated, the optimal trajectory phase 60 provides the golfer with an aim point 62. The putting device 50 may be structured to provide an aim point 62. For example, the aim point 62 may be indicated by a laser dot projected onto the practice green 76. Additionally, the putting device 50 may be structured to display the optimal force 96 with which the putt should be struck. Reference character 114 illustrates one non-limiting example of a display, which may be shown by putting device 50 to provide golfer with information relevant to striking a putt with optimal putt trajectory 94 and optimal force 96. Display 114 indicates both pin distance and the optimal force with which the putt should be struck. In the depicted non-limiting example, the cup 80 is 11.2 feet from the ball spot 110, but because of topographical features and other relevant conditions, the ball should be struck with an optimal force to carry the ball 14.8 feet.

Figure 8:
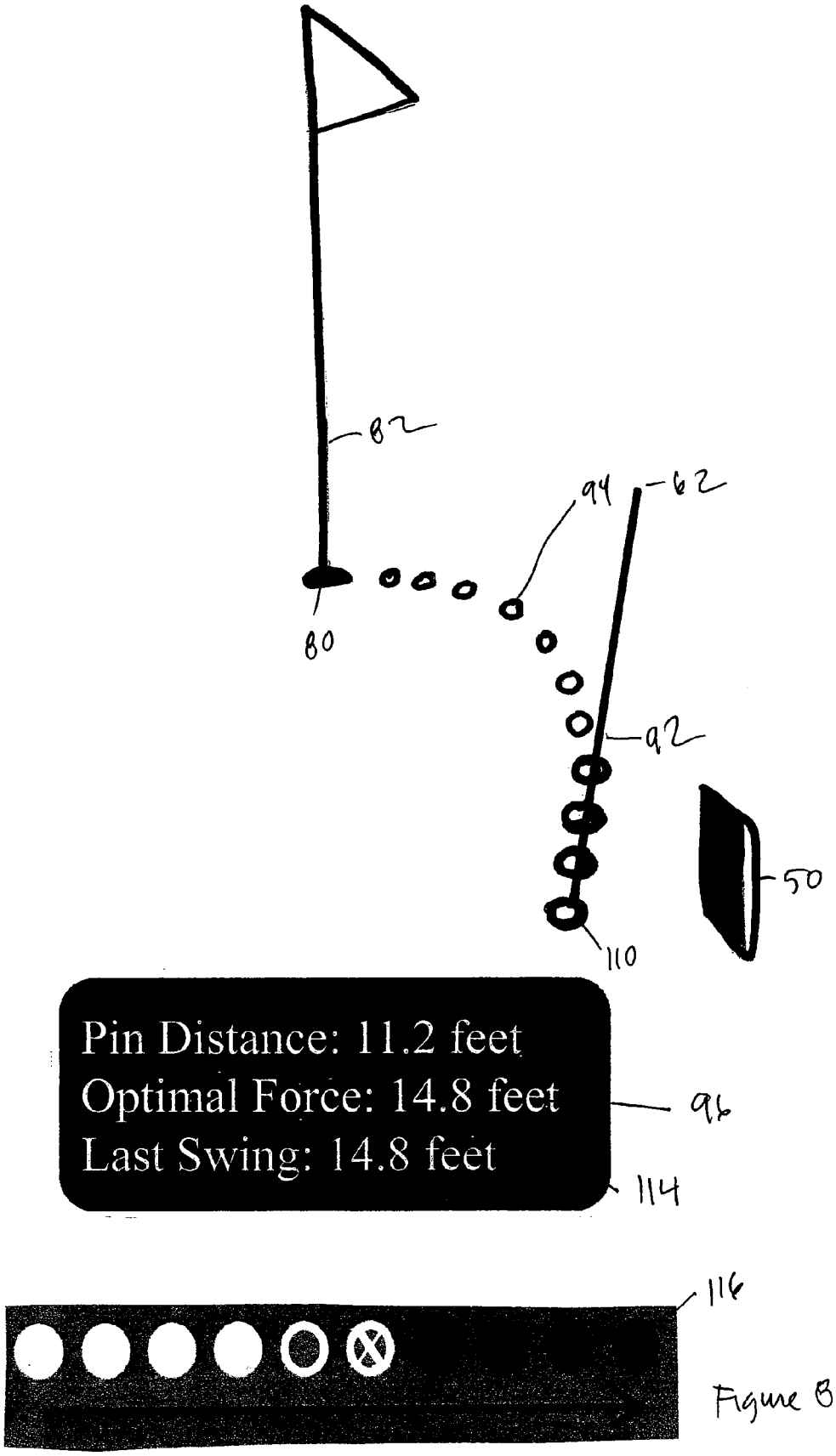
FIG. 8 shows a representation of a mobile putting device displaying pin distance, optimal swing force, last swing force, optimal aiming point and optimal trajectory according to some embodiments of the invention.

Referring to FIG. 8, subsequent to receiving optimal trajectory 94, which may include optimal force 96 information, the player may take additional practice putting swings. In some embodiments, the practice swings may be measured to provide the player with accurate, instant and reliable information including the actual force at impact and/or the path on with the ball was or would have been struck. Graphical representations 116 may also be utilized to indicate how close the swing, or practice swing, was to optimal. In the non-limiting example illustrated in FIG. 8, the pin distance is approximately 11.2 feet from the ball spot 110 and should be struck with a force sufficient to carry a ball 14.8 ft because of topographical conditions, contours of the green 76 and other influencing factors. As depicted in FIG. 8, graphical representation 116 indicates a spectrum of insufficient force to excessive force. As a practice stroke is taken by the golfer, the graphical representation 116 illustrates the amount of force produced by the swing relative to the optimal force desired, and display 114 indicates the force of the last swing. In this fashion, a golfer receives immediate, accurate feedback on each practice stroke and on each putt.

Preferred embodiments may utilize technology to determine the distance a ball would travel on a given putting surface when struck by the putter moving a given speed. Some embodiments of the putting device 50 utilize a device which is structured to measure the speed of the head of the putter through the hitting zone, where the ball is or will be placed once the ball is struck. Various technologies may be utilized to determine swing speed through the hitting zone. In some embodiments the putting device 50 may incorporate one or more sensors 100 designed to measure the putter's head speed as it passes the point of impact, with or without a ball being present. In some embodiments the putter speed through the point of impact can be used to calculate the balls initial launch velocity. Combining launch velocity with other data, (e.g., green speed parameters such as stimp measurements, topography, grain etc. . . . ,) allows the production of an estimate the distance a ball would travel when putted.

In accordance with the present invention embodiments may utilize various single sensor 100 technologies and/or various multi-sensor 100 technologies. For example some preferred embodiments may utilize one or more Doppler technologies. For example, radio, optical or acoustical Doppler sensor(s) 100 may be utilized to measure putter speed through a hitting zone. In other preferred embodiments multi-sensor 100 technology may be utilized. For example, time of flight technologies may be utilized whereby the speed of the putter head through the impact zone may be determined by measuring the time the putter head takes to travel between two or more fixed points spread over a known distance.

In some embodiments sensor (s) 100 may be a Doppler sensor. Some embodiments may utilize radio, optical or acoustic Doppler sensor(s) 100. In a non-limiting example, the putting device 50 may be structured to include a simple Doppler sensor 100 that may be utilized to measure the motion of the putter head relative to the putting device 50. The Doppler sensor 100 may measure a dramatic range of swing speeds. In a non-limiting example, sensor 100 may measure swing speeds from 0.01 miles per hour to over 500 miles per hour. Further, the sensor 100 may be structured or adjusted to measure with particular sensitivity speeds typical to putting. In some embodiments, sensor 100 may be designed to determine relative speed over very short time intervals. In a non-limiting example, sensor 100 may have an update period of less than $1/1000^{th}$ of a second allowing the sensor to track objects rapidly accelerating objects. In other embodiments sensor 100 may have an update period between $1/1000^{th}$ of a second and $1/100^{th}$ of a second. And in other embodiments the update period may be greater than $1/100^{th}$ of a second.

In some embodiments a laser Doppler sensor(s) 100 may be utilized. In a non-limiting example, laser Doppler sensor 100 may utilize an optical sensor with a single processing unit. Alternatively, multiple laser Doppler sensors may be used in combination. Typical laser Doppler sensor 10 may be structured to have measurement range between −1000 to 10,000 mm/sec, a focal length between 1 mm and 400 mm, a focus dept between 1 mm and 100 mm, an adjustable laser spot size, a variable effective object surface. The sensor 100 may be structured to provide exact speed measurements, or measurements with variable speed certainty where measurement certainty nearly approximates actual swing speed through the hitting zone. Sensor 100 may be structured to operate in a wide variety of operating conditions allowing for practice in various lighting, during inclement weather, during different times of the year through variable temperature ranges, or indoors.

Sound sensor 100 may be utilized to provide time of flight data. The time of flight data may be utilized to calculate swing speed through the hitting zone.

In preferred embodiments, the swing speed data may be utilized in conjunction with other acquired data to perform calculations necessary to provide a golfer with an accurate assessment of how far the ball will travel when struck with a putter being swung through the hitting zone at the measured speed. In some embodiments the putting device may allow a golfer to input data about the type of putter being used. The data may include the weight of the putter, the loft of the face, hardness of putter face, etc. In a non-limiting example putter information maybe preloaded onto the putting device before use. Then on use, a golfer may select the type of putter being utilized. The associated physical properties of the given putter would then be available for performing distance calculations. As an element in the distance calculations, putter head speed and putter characteristics maybe utilized with other collected data including but not limited to positional data, topographical data.

In preferred embodiments, topographical data and the current Stimpmeter reading may be downloaded to the device 50 before use. In some embodiments, the calculation of the intended putt parameters would be performed on the device 50. Alternatively, topographical data and current Stimpmeter readings may be stored remotely and accessed via various networking 38 systems during a training session.

In some embodiments, the device 50 may comprise a high resolution, digital compass that will provide the angle to true north, which may be utilized as a data point utilized to triangulate the position of the device on the putting surface. In some embodiments, multiple digital compasses may be utilized to increase the accuracy of the information acquired.

In some embodiments, the golfer may receive instructions for every hole on the practice green, golf course or interactive media play practice green. The golfer may select the hole he wishes to putt to, receive the instructions, and when completed with that hole, he will select another and receive a readout of the instructions for that hole.

Figure 9:
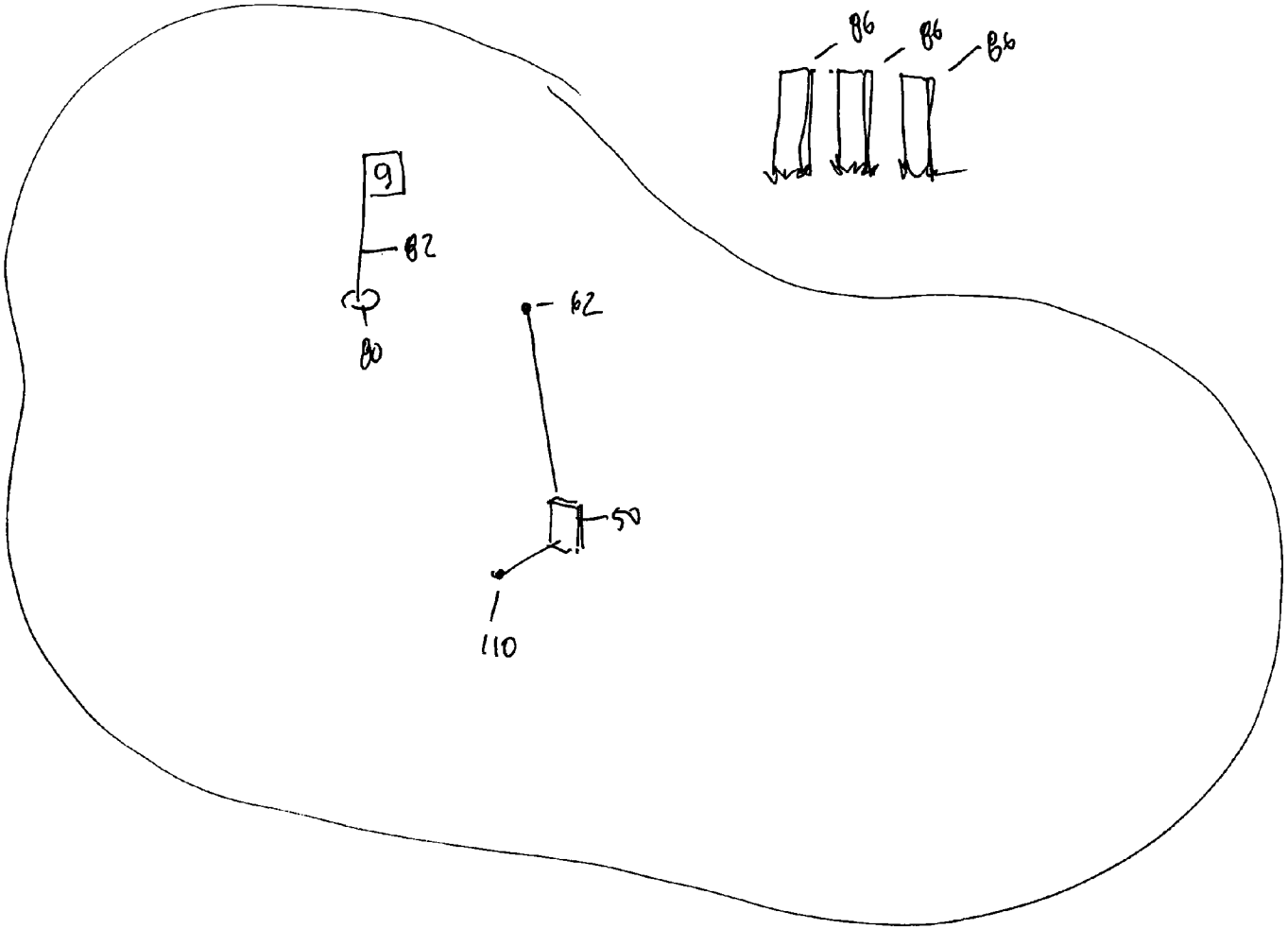
FIG. 9 shows a representation of a mobile putting device indicating ball placement and optimal aim point as determined utilizing positional identifiers according to some embodiments of the invention.
Figure 10:
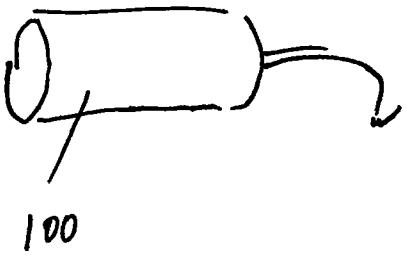
FIG. 10 shows a representation of a sensor according to some embodiments which may be utilized to determine putter swing speed.
Figure 11:
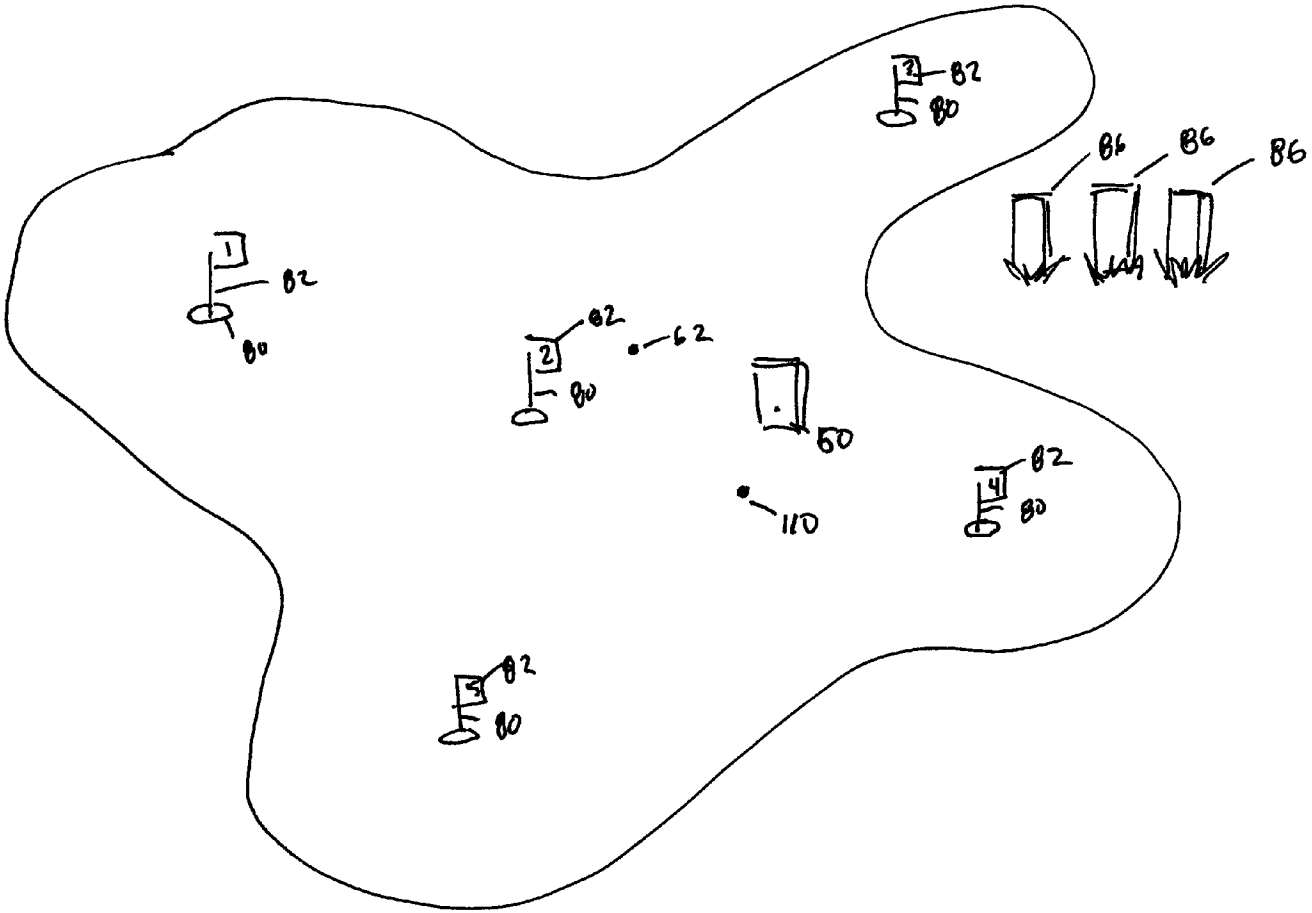
FIG. 11 shows a representation of a practice putting area according to some embodiments of the invention.

As depicted in FIG. 9, mobile putting device 50 may be used in accordance with alternative embodiments. In some embodiments, position identifiers 86 proximate a putting surface 52 may be utilized to augment the accuracy of position data utilized by the putting device 50. In some embodiments, position identifiers 86 placed proximate to a putting surface 52, a known distance from the putting surface 52 and a known distance from other position identifiers 86 are included in the topographical measurements acquired for each putting surface. According to some embodiments, three or more position identifiers 86, e.g., poles, may be placed proximate a putting surface. For example in some embodiments, before scanning the putting surface for topographical measurements, three position identifiers 86 may be placed approximately 2-3 feet apart a few yards past the putting surface. The exact placement of these position identifiers 86 may then be included in the topographical scanning/mapping of the putting surface. Each position identifier 86 may be structured to broadcast or reflect a different signal. For example each of the poles may broadcast different ultrasound signals (e.g, 40 kHz, 50 kHz, and 55 kHz). The device 50 may then measure the difference in time between reception of signals from the independent poles to triangulate position of the device in the scanned topographical putting surface. Alternatively, the position identifiers 86 may utilize RFID tags or transponders. The transponders may be passive or active. Because of the small size of the RFID tags, courses and practice putting surfaces could easily be retrofitted to work with such embodiments.

The different signals received by the putting device 50 placed on the green from each of the position identifiers 86 may provide the basis for triangulation/location of the newly drilled holes/cups 80 and to identify the placement of the putting device 50 on the green by the golfer. The actual calculation could be performed either on the device 50 placed on the green 76, at the position identifiers 86 or at a location remote from the green.

In some embodiments, where calculations (e.g., path and speed algorithms) are performed at the position identifiers 86 or at a remote location, then results from calculations performed (e.g., actual aim point instruction and the swing speed instruction) may be transferred through a transmitter (e.g., a ultrasound transmission device) to the requesting device. This could be done for all puttable holes on the putting green and for the unique placement of the device 50 on the green 76. In some embodiments, the power requirements for the position identifiers 86 may be supplied by solar powered batteries.

In other embodiments a Global Positioning System (GPS) may be utilized to provide the location of the cup 80, ball 84, and putting device 50 on the putting surface 76. In some embodiments, the GPS information may be substituted with, or augmented with Differential Global Positioning information, Dual Frequency Global Positioning information (DGPS), and Carrier Phase Global Positioning to augment the Global Positioning Information.

In some embodiments utilizing a DGPS, or other positional information, one or more GPS receivers 86 are placed at stationary, known locations, near to where accurate position determination is desired. The receivers 86 broadcast the range errors received from at least some and preferably all of the GPS satellites with which the receiver 86 is in communication with. In some embodiments, the transmission of position information is by way of radio beacons. In other embodiments geostationary satellites and the Internet may be utilized.

In some embodiments, DGPS receivers may use these correction messages, correlated with the satellite signals being received, to provide higher resolution positioning information. In some embodiments, the accuracy attained is a function of distance from the DGPS stations, the number of DGPS stations utilized, and how rapidly the stations broadcast data.

The putting device may be configured to adapt to different learning styles. The device may be capable of receiving learning style information or assessing learning style information as the machine is repeatedly utilized by a particular user. In some embodiments device may record data utilized to assess rate of improvement and correlate rate of improvement with variable feedback mechanisms. For example each practice swing may be followed by an LED indication of swing speed, providing a golfer with an immediate visual cue related to relative swing speed. The device 50 may be configured to provide the user with an audio cue. For example a polite golf clap or crowd roar may follow a perfectly struck putt or a putting stroke taken at an optimal speed. In another example the device could be structured to provide auditory information about swing speed, either directly reporting swing speed, reporting the distance the putt would have or did travel or with a sound effect increases in intensity or pitch in association with increasing swing speeds. Accordingly, the device may be configured and/or adapt configuration automatically to adjust feedback to provide optimal rates of learning for each particular learner.

The device 50 may be available in various configurations. For example the device 50 may be comprised of one unit capable of performing all of the functions described herein, may be portable or located at a particular location and access via a network. Alternatively, the device 50 may be comprised of multiple units that are capable of functioning separately or combined. For example the device 50 may be comprised of a unit that measures swing speed and a unit that stores topography information provides trajectory information. In such embodiments the unit for measuring swing speed may be very small and utilized in settings that do not require topographical information (e.g., a carpet floor). Alternatively, the device could be a small personal computing unit (e.g., PDA, BLACKBERRY, etc.) carried on the golfer during a putting session. The personal computing unit could perform all or some of the described functions and may communicated putting information via Bluetooth technology to a golfer through an ear piece providing topography information, trajectory information, swing speed information or information related to any data useful to a putter during the putting process (e.g., current wind speeds, direction of grain type of grass on the surface, distance to hole, etc.).

The present invention may be embodied in other specific forms without departing from its spirit or essential characteristics. The described embodiments are to be considered in all respects only as illustrative and not restrictive. The scope of the invention is, therefore, indicated by the appended claims, rather than by the foregoing description. All changes which come within the meaning and range of equivalency of the claims are to be embraced within their scope.

What is claimed and desired to be secured by Letters Patent is:

1. A putting improvement method:

utilizing a putting device comprising a housing, wherein the housing comprises an indication for orienting the putting device with respect to a cup in a putting surface when the putting device is placed on the putting surface proximate to a position of a ball lying on the putting surface, the indication for orientating the putting device defining a line from the putting device that intersects the cup;

aligning the putting device with one of a flag, a stationary object, and the cup utilizing the indication for orienting the putting device with respect to the cup manually aligning the putting device with the cup;

utilizing the putting device to perform the steps comprising:

identifying an initial location at which the ball should be placed relative to the putting device the position at which the ball should be placed relative to the putting device utilizing location indicia;

determining a distance between the putting device and the cup comprising at least one of utilizing the putting device to remotely detect a transceiver in the flag or the cup, or manually inputting into the putting device an estimate of the distance between the putting device and the cup;

utilizing (a) the distance between the putting device and the cup, with (b) location data comprising at least one of (i) a known position of the cup, or (ii) a known position of the flag, or (iii) a known position of the stationary object, with (c) a compass resident in the putting device, to triangulate the position of the putting device on the putting surface;

determining an aim point toward which the ball on the putting surface should be struck with a putter from the initial location to arrive in the cup in the putting surface;

determining an optimal speed with which the ball should be struck toward the aim point to arrive in the cup;

providing visual indicia of the aim point indicating a position toward which the ball should be struck;

displaying the optimal speed with which the ball should be struck toward the aim point to arrive in the cup;

measuring a speed of a putter head through a hitting zone during a swing; and providing feedback on the swing based on the speed of the putter head during the swing and the optimal speed.

2. The method of claim 1, further comprising providing a golfer with an optimal ball trajectory, including an initial path the ball should be struck on.

3. The method of claim 1, wherein the feedback is one of visual feedback and auditory feedback on a distance the swing would move the ball if the ball was in the hitting zone during the swing.

4. The method of claim 1, further comprising an initial set up phase comprising:

placing the putting device on the putting surface;

initiating an alignment of the putting device by actuating the putting device with at least one of remotely with a control, with an audio command, by Bluetooth transmission and manually by pressing a button on the putting device itself; and utilizing a laser to project one of a spot and a line on the putting surface to indicate the aim point.

5. The method of claim 1, wherein determining the aim point and the optimal speed includes utilizing information selected from a group consisting of topographical information, type of grass utilized to make the putting surface, a grain of the putting surface, current wind conditions, a time of day, a length of grass, a contour of the putting surface itself, a lie of the land surrounding the putting surface, green speed information, current wind speed, current weather information, and anticipated weather information.

6. The method of claim 1, further comprising:

storing topographical data;

aligning the putting device with a stationary object;

accessing the stored topography data;

performing a calculation to determine a position of the putting device.

7. The method of claim 6, further comprising utilizing a distance between the ball and the putting device to calculate a position of the ball relative to a position of the stationary object within an environment of a topography identified by the topographical data.

8. The method of claim 7, wherein determining the aim point and the optimal speed includes utilizing the topographical data and the position of the ball relative to the position of the stationary object.

9. The method of claim 6, wherein performing the calculation to determine a position of the putting device comprising utilizing a Global Positioning System to provide the position of the putting device on the putting surface.

10. The method of claim 9, further comprising utilizing information selected from a group consisting of Differential Global Positioning information, Dual Frequency Global Positioning information, and Carrier Phase Global Positioning to augment a Global Positioning Information.

11. The method of claim 10, further comprising utilizing the information acquired from a group consisting of Differential Global Positioning units, Dual Frequency Global Positioning units, and Carrier Phase Global Positioning units to correlate with satellite signals being received, to provide higher resolution positioning information.

12. The method of claim 1, wherein utilizing the putting device to provide the aim point indicating a position toward which the ball should be struck comprises displaying a laser dot projected on the putting surface.

13. The method of claim 1, further comprising providing an indication of the optimal swing speed with which the ball should be struck toward the aim point to arrive in the cup.

14. The method of claim 1, wherein providing the feedback includes providing information relating to an initial launch velocity and a concomitant distance the ball was or would have been struck based on the measured speed through the hitting zone during the swing.

15. The method of claim 14, wherein the information relating to the initial launch velocity and the concomitant distance the ball comprises an indication of how close the swing was to optimal.

16. The method of claim 15, wherein utilizing the putting device to determine the aim point and the optimal speed utilizes information selected from a group consisting of topographical information, type of grass utilized to make the putting surface, a grain of the putting surface, current wind conditions, a time of day, a length of grass, contours of the putting surface itself, a lie of the land surrounding the putting surface, green speed information, current wind speed, current weather information, and anticipated weather information.

17. The method of claim 1, further comprising utilizing the putting device comprising a digital compass to provide an angle to true north, to be utilized as a data point to triangulate the position of the putting device on the putting surface.

18. The method of claim 1, further comprising placing position identifiers proximate the putting surface.

19. The method of claim 18, wherein the placement of the position identifiers may be included in a topographical scanned map of the putting surface.

20. The method of claim 18, further comprising broadcasting a different signal from each of the position identifiers.

21. The method of claim 20, further comprising receiving the signals from each of the position identifiers at the putting device.

22. The method of claim 21, further comprising utilizing the multiple signals from the position identifiers for identifying a location of the putting device on the putting surface.

23. The method of claim 1, further comprising utilizing audio cues to interact with the putting device.

24. The method of claim 23, wherein the step of utilizing the audio cues comprises utilizing Bluetooth technology to transmit commands to the putting device.

25. The method of claim 1, further comprising configuring the putting device to adapt to different learning styles.

26. A putting improvement device comprising:

an alignment element structured to align the putting device with one of a cup, a flag, or a stationary object comprising at least one of: utilizing the putting device to remotely detect a transceiver in the flag, the cup, or the stationary object, and utilizing the alignment element to manually align the putting device with one of the flag, the cup, or the stationary object;

a ball location identifier structured to identify a position at which a ball should be placed relative to the putting device;

a processor configured to perform the steps comprising:

determining a distance between the putting device and the cup comprising at least one of utilizing the putting device to remotely detect a transceiver in the flag or the cup, or manually inputting into the putting device an estimate of the distance between the putting device and the cup;

triangulate the position of the putting device on a putting surface utilizing (a) the distance between the putting device and the cup, with (b) location data comprising at least one of (i) a known position of the cup, or (ii) a known position of the flag, or (iii) the known position of a stationary object, with (c) a compass resident in the putting device, calculating the position of the ball relative to the position of the cup;

determining an aim point toward which the ball should be struck with a putter from the position of the ball on the putting surface to arrive in the cup on the putting surface; and determining an optimal speed with which the ball should be struck toward the aim point to arrive in the cup;

a position identifier structured to provide a visual indicia of the aim point toward which the ball should be struck;

a swing speed indicator structured to provide a visual representation of the optimal speed the ball should be struck;

one or more sensors structured to measure a speed of a head of the putter through a hitting zone during a swing; and a feedback mechanism structured to provide feedback of the swing based on the measured speed of the head of the putter during the swing and the optimal speed.

* * * * *